US009862573B2

(12) United States Patent
Püntener et al.

(10) Patent No.: US 9,862,573 B2
(45) Date of Patent: Jan. 9, 2018

(54) BEARING MEANS BRAKE DEVICE

(71) Applicant: Inventio AG, Hergiswil (CH)

(72) Inventors: Urs Püntener, Ebikon (CH); Marcel Koch, Attinghausen (CH); Stefan Weber, Berikon (CH)

(73) Assignee: INVENTIO AG, Hergiswil NW (CH)

( * ) Notice: Subject to any disclaimer, the term of this patent is extended or adjusted under 35 U.S.C. 154(b) by 0 days.

(21) Appl. No.: 14/894,556

(22) PCT Filed: May 27, 2014

(86) PCT No.: PCT/EP2014/060881
§ 371 (c)(1),
(2) Date: Nov. 30, 2015

(87) PCT Pub. No.: WO2014/191376
PCT Pub. Date: Dec. 4, 2014

(65) Prior Publication Data

US 2016/0101968 A1 Apr. 14, 2016

(30) Foreign Application Priority Data

May 28, 2013 (EP) ..... 13169551

(51) Int. Cl.
*B66B 19/02* (2006.01)

(52) U.S. Cl.
CPC ..... *B66B 19/02* (2013.01)

(58) Field of Classification Search
CPC ..... B66B 19/02; B66D 1/76; B63B 35/04; B65H 59/06; B65H 59/10; B65H 59/22
See application file for complete search history.

(56) References Cited

U.S. PATENT DOCUMENTS 557,831 A * 4/1896 Kirwin ..... B65H 59/10 242/152
1,487,562 A * 3/1924 Hawkins ..... D03D 49/06 139/109

(Continued)

FOREIGN PATENT DOCUMENTS

CN 1673063 A 9/2005
CN 101511719 A 8/2009

(Continued)

OTHER PUBLICATIONS

Brugg Catalog, 2012.

*Primary Examiner* — Minh Truong
(74) *Attorney, Agent, or Firm* — William J. Clemens; Shumaker, Loop & Kendrick, LLP

(57) ABSTRACT

A method for introducing an elevator support into an elevator system includes a support brake device for controlling a drawing-in speed of the elevator support. The elevator support is wound on a support roller at a floor or in a machine room of a building. The elevator support is unwound from the roller and introduced into a shaft of the elevator system. The support brake device is arranged between the support roller and the shaft, and a drawing-in speed of the elevator support is adjusted by the support brake device. The support brake device contains a traction pulley for receiving the elevator support that is rotatably mounted in a support frame so that the elevator support can at least partly loop around the traction pulley. The traction pulley is braked by a pulley brake device, whereby the drawing-in speed can be controlled.

10 Claims, 6 Drawing Sheets

(56) References Cited

U.S. PATENT DOCUMENTS

| | | | | | |
|---|---|---|---|---|---|
| 2,435,447 | A * | 2/1948 | Kortum | B63B 21/06 | 114/199 |
| 3,143,309 | A * | 8/1964 | Clarke | B63B 35/04 | 226/108 |
| 3,472,343 | A * | 10/1969 | Williams | A61G 15/16 | 188/65.1 |
| 4,071,926 | A * | 2/1978 | Sweet | A62B 1/14 | 182/8 |
| 4,920,680 | A * | 5/1990 | Lindgren | A01K 91/18 | 254/362 |
| 5,299,780 | A * | 4/1994 | Sugiyama | B66D 1/7415 | 226/190 |
| 6,948,594 | B2 * | 9/2005 | Hossler | A63J 1/028 | 188/65.1 |
| 8,112,861 | B2 * | 2/2012 | Korkeakangas | B66B 19/02 | 187/414 |
| 8,317,160 | B2 * | 11/2012 | Romo | B66B 11/08 | 182/142 |
| 9,561,935 | B2 * | 2/2017 | Perala | B66B 19/00 | |
| 9,604,823 | B2 * | 3/2017 | Sheynkman | B66B 19/02 | |
| 2009/0101448 | A1 * | 4/2009 | Korkeakangas | B66B 19/02 | 187/261 |
| 2010/0000823 | A1 * | 1/2010 | Sheynkman | B66B 19/02 | 187/251 |
| 2012/0291395 | A1 * | 11/2012 | Plathin | B66B 19/02 | 52/741.1 |
| 2013/0111723 | A1 * | 5/2013 | Forsstrom | B66B 19/02 | 29/401.1 |

FOREIGN PATENT DOCUMENTS

| | | | |
|---|---|---|---|
| CN | 102633177 | A | 8/2012 |
| JP | S6417788 | A | 1/1989 |
| JP | H03120185 | A | 5/1991 |
| JP | H0986823 | A | 3/1997 |
| JP | H1087217 | A | 4/1998 |
| JP | 2000344440 | A | 12/2000 |
| JP | 2003040551 | A | 2/2003 |
| JP | 2005015071 | A | 1/2005 |
| JP | 2005263476 | A | 9/2005 |

* cited by examiner

Prior Art

B - B

A - A

BEARING MEANS BRAKE DEVICE

FIELD

The invention relates to a method of introducing a support means of an elevator into an elevator installation, and to a support means brake device for controlling an intake speed of the support means during introduction thereof into the elevator installation. In addition, the invention relates to use of a support means brake device of that kind for carrying out the method of introducing a support means into an elevator installation.

BACKGROUND

The elevator installation is installed in a building or attached thereto. For that purpose, the building contains a shaft which extends over several floors of the building. The elevator installation consists substantially of a car which is connected with a counterweight or with a second car by way of support means. The car is moved along substantially vertical guide rails in the shaft by way of a drive, which usually acts on the support means. The elevator installation is used to convey persons and goods within the building. For installing the elevator installation in the building, the principal components of the elevator installation such as the car, counterweight and drive are usually assembled and installed at appropriate locations in the shaft or in a machine room of the elevator installation. The support means are also installed at an earliest point in time so as to then be able to move the elevator.

A method of installing support means in the elevator installation is known from JP2000-344440. In that regard, the support means is unrolled from a support means roller, guided over the drive machine and then lowered in the elevator shaft by way of a guide roller.

Since the intrinsic weight of the support means during lowering in the elevator shaft constantly increases, an intrinsic dynamic arises especially in the case of elevator installations with greater conveying heights. This has the effect that the support means is automatically drawn off the support means roller and in the case of inattention on the part of assembly personnel drops into the elevator shaft. In order to counteract this risk, a reel brake is known from, for example, JP10-87217. The support means roller can be braked, if required, by way of the reel brake. However, the mentioned risk is not thereby completely eliminated. Since the support means are usually cut to length in correspondence with the required conveying height, the support means can slip off the support means roller in the final phase.

A further device for braking a support means is known from JP2005-015071. A brake jaw can be pressed against a brake drum by means of a brake lever by way of a wire pull so that the associated support means roller can, when required, be braked or held. The brake lever can be fixed in a braking position and, when required, unlocked and released. However, the mentioned risk is also not eliminated by this. Since the support means are usually cut to length in correspondence the required conveying height the support means can slip from the support means reel in the final phase, as a consequence of which braking of the support means roller is no longer effective. In addition, the brake lever is actively released and equally has to be actively tightened again. In the case of inattention, in a borderline situation no braking takes place.

A method of replacing an existing old support means by a new support means is present in JP2005-263476. In that regard, the old support means and the new support means are guided around the same axle or roller and braked.

SUMMARY

The invention has an object of providing a method and a corresponding device for introducing the support means into an elevator installation with consideration of the risks demonstrated in the prior art.

The solutions described in the following diminish at least one of the demonstrated risks and increase the safety and quality of elevator assembly.

In particular, a method of introducing a support means into an elevator installation is proposed. The elevator installation connects several floors of a building with one another. Essential parts of the elevator installation such as an elevator car, a counterweight or further installation material are arranged in a shaft of the building. The shaft extends over several floors of the building. The several floors comprise at least the floors made accessible by the elevator installation. The elevator car or at least parts thereof is or are preferably preassembled in an upper region of the shaft and the counterweight is preassembled in a lower region of the shaft. The support means is wound up on a support means roller and this is provided in the vicinity of the shaft. The support means can thus be unwound from the support means roller and introduced into the shaft of the elevator installation. The method includes the following steps: A support means brake device is, in addition to the support means roller, arranged between the support means roller of the elevator shaft. The support means is introduced into the support means brake device and an intake speed of the support means is controlled by way of the support means brake device.

This is advantageous, since the support means brake device can brake and hold the support means independently of the support means roller. This is achieved in that, in particular, the support means brake device is arranged, after the support means roller, between this and the elevator shaft. The support means roller is often a wooden reel and this reel is now protected from braking forces. The support means brake device can be simply pushed from installing location to installing location and be appropriately optimized for the function of "braking".

The vicinity of the shaft in which the support means roller is provided is selected in accordance with the kind of elevator and in accordance with accessibility in the building. The vicinity is connected at least with a passage to the shaft, wherein the passage enables at least guidance of the support means through to the shaft. The vicinity can be a space or three-dimensional region adjoining the shaft or it can also be a remote space if, for example, the adjoining space is too tight. In one embodiment the support means roller is provided on a floor of the building, preferably on an uppermost floor of the building. This is advantageous, since floors are usually readily accessible and thus the support means roller can be readily delivered and placed near the shaft. Thus, the paths to the shaft can be kept small for the subsequent installing of the support means. In another embodiment, the support means roller is provided in a machine room of the building. The machine room is present, primarily in elevators with large transport heights, often directly above the shaft. Provision of the support means roller in the machine room or possibly in an antechamber to the machine room is advantageous since the support means is thus usually at the highest point of the elevator installation and thus no further lifting energy for installing the support means is required.

Advantageously, the introduction of the support means comprises the following steps: The support means is preferably introduced into the support means brake device in that a first end of the support means is unrolled from the support means roller and this first end is guided through the support means brake device. In addition, the first end of the support means is guided through a first floor door, preferably drawn into the machine room or to the drive, and is guided around a pulley of the elevator drive. The first end of the support means is subsequently fastened to a support means fastening point, preferably directly to the definitive fastening point thereof, and the support means is lowered in the elevator shaft. In that case, a loop of the support means is preferably weighted and guided by means of a guide roller.

The support means is thus drawn into the shaft substantially by an intrinsic weight of the support means and a mass of the guide roller. The guide roller prevents twisting of the support means loop. Moreover, the drawing-in of the support means or the intake speed thereof can be simply and safety controlled or regulated by way of the support means brake.

In addition, after the loop of the support means has been introduced into the shaft substantially up to its desired length, the loop of the support means is preferably detached from the guide roller and placed around a corresponding deflecting roller of a counterweight.

A second end of the support means is obviously drawn through the support means brake device after it has been unrolled from the support means roller. Thereafter, after looping into appropriate deflecting rollers of the elevator car it is fastened to a support means fastening point on the car side or provisionally fixed in the machine room. The support means fastening point on the car side is in that case the fastening point at which the second end of the support means is suspended or fastened. The fastening of the second end of the support means at the support means fastening point on the car side can be carried out conjunctively for all support means after these have been drawn into the shaft. In order that the loose second end of the support means does not slip into the shaft during drawing-in of the remaining support means, the second end of the support means is fixedly clamped in the upper region of the shaft or preferably in the machine room by way of a support means clamp and thus temporarily fixed.

Obviously, in the case of elevator installations without deflecting rollers at the counterweight and the elevator car the first end of the support means can also be directly fixed to a guide carriage and lowered in the shaft. Untwisting or twisting of the support means is prevented by the fixing.

The support means brake device is preferably designed in such a way that together with a traction resistance of the pulley of the drive it can exert a sufficient braking force for secure holding of the support means. However, alternatively or additionally the pulley of the drive can also be provided with a slide device which enables simple pulling-through of the support means over the pulley of the drive. On the one hand the pulley is thus protected and the initial force is reduced above all at the start of drawing-in of the support means. The initial force is required until the intrinsic weight of the support means together with the weight of the guide roller is high enough to automatically draw the support means over the pulley of the drive. On the other hand, in the case of use of a slide device at the drive a braking force of the support means brake device has to be designed to be stronger, since the traction resistance of the pulley of the drive is reduced.

The method described in the preceding is now preferably repeated for each individual support means until all support means of the elevator installation have been mounted or drawn in.

Controlling of the intake speed of the support means is preferably carried out in that the braking force of the support means brake device is regulated by actuation, preferably by manual actuation, of a brake lever preferably biased by way of a spring or a weight mass. In that case, for example in the absence of manual actuation, a predetermined braking force is automatically set. This takes place, for example, in that a weight-loaded or spring-loaded brake lever urges a brake into a braking setting in the absence of the external action of force. The brake lever is manually relieved of force by hand, foot or other form of actuation of the brake lever, thus by a manual actuation, and the braking force of the support means brake device is thereby reduced. The braking force can thereby be manually regulated and a safeguard is provided, since in the absence of manual actuation the support means is automatically braked. The design of the brake preferably provides that movement of the support means is stopped in the absence of manual actuation or in the absence of an actuating force.

Alternatively, controlling of the intake speed of the support means can also be carried out in that an intake speed is detected and the braking force of the support means brake device is regulated by way of a regulating device. Detection of the intake speed can be carried out by way of a tachometer or any rotational speed transmitter. Moreover, the regulating device can, for example, so regulate an electromechanical or hydraulic brake device that the intake speed does not exceed a predetermined speed limit value.

A support means brake device suitable for carrying out the present method preferably comprises a traction pulley for receiving the support means. The traction pulley is in that case rotatably mounted in a support frame and is constructed in such a way that the support means can at least partly loop around the traction pulley. Moreover, the support means brake device includes the brake device for braking the traction pulley, wherein the intake speed is controllable by the brake device. This is advantageous, since the support means is moved in company with the traction pulley. The support means is accordingly protected, since it does not have to slide on the traction pulley. Due to the fact that the brake device acts on the traction pulley, well-defined brake partners are present in its action and the braking is correspondingly reliable. This 'indirect' form of braking is to precede direct braking in which, for example, a pressing force acts directly on the support means. In the case of use of a direct pressing force on the support means this is, in particular, strongly pressed locally and exposed to substantial frictional loading.

The support means brake device preferably includes a support means entry guide for receiving a support means run which is running into the support means brake device. This support means entry guide is constructed so that the support means is guided from a substantially horizontal entry direction to a traction groove of the traction pulley. In addition, the support means brake device includes a support means departure guide for guidance away of a support means run which is running away from the traction pulley. The support means departure guide is constructed in such a manner that the support means is guided from the traction groove of the traction pulley in a departure direction. The departure direction approximately corresponds with a draw-out direction in which the support means runs away into the shaft. The two support means guides are in addition constructed in such a way that the entering support means run and the departing support means run do not obstruct one another. The support means guides thus guide the two support means runs preferably laterally past one another. For example, the departing support means run runs linearly away from the traction groove, whereas the entering traction means run runs laterally past the departing support means run at an offset and is then guided in a curve to the traction groove. The proposed construction has the effect that the entering run stressed with lower force is deflected laterally. This construction allows provision of a compact device which can gently and securely guide and brake the support means.

The support means brake device preferably additionally comprises a pressing roller. This is arranged in such a manner that the entering support means run is pressed against the traction pulley or the traction groove of the traction pulley in the vicinity of the location at which the support means runs onto the traction pulley. The maximum braking force transmissible by the traction pulley to the support means can thereby be increased. The increase arises due to the fact that the resulting withdrawing force or the resulting maximum braking force of the support means brake device is determined starting from the frictional force, which is determined by the pressing force, over the following looping angle. The pressing roller is preferably pressed against the traction pulley by way of a spring device.

The pressing roller can preferably be released or lifted off the traction pulley by way of a lever—for example, an arm of a brake lever can be adapted for that purpose—or in another way. Movement of the support means into the support means braking device can thereby be facilitated.

Preferably, the support means brake device comprises a first band brake which includes a band disc, which is connected with the traction pulley, and a brake band. The brake band loops around the band disc and is tightened by means of the brake lever, which is preferably biased. The brake lever is designed in such a way that it is preferably manually actuable. Band brakes are reliable in function and can be realized economically.

The brake lever is preferably biased by means of a spring or by means of weight mass, so that in the absence of manual action the band brake brakes in correspondence with the biasing of the spring or the weight mass. This is advantageous, since it is thereby ensured that in the absence of manual action there is braking by the band brake and thus the support means brake device. Operational reliability of the support means brake device is thereby increased.

The support means brake device preferably additionally comprises a second band brake, which includes a further band disc and which is similarly connected with the traction pulley. This second band brake comprises a further brake band which embraces the second band disc. By comparison with the preceding brake band, the further brake band preferably has a higher level of friction and the second band brake can be brought into action by the brake lever if the preceding brake band fails. A longer-term use of the support means brake device is also thereby possible at different mounting places since a defect of the first band brake is recognized and the support means can nevertheless be securely stopped. The first band brake can be repaired without substantial follow-on costs.

The brake band of the first band brake preferably consists of a textile material or a plastics material, whereas the further brake band consists of, for example, metallic material.

The traction pulley of the support means brake device is preferably rotatably mounted in the support frame together with the connected band discs and the further parts such as brake lever, support means guides and presser roller or guide roller are arranged in the support frame. The support frame thus forms a load-bearing basic structure and the entire device can be transported in simple manner.

The support means brake device can preferably be fastened on a floor of the building by way of the support frame. It can be temporarily fastened on a surface of the floor by means of, for example, studs or it can be supported on or braced at a wall, for example a wall of the elevator shaft.

In one possible embodiment the support frame comprises a transport wheel which comes into contact with a surface of the floor by tipping the support means brake device. A simple displacement of the support means brake device is thereby made possible. The brake lever can, for example, be fixed to the support frame for the purpose of transport and the support means brake device can be lifted or tipped by way of the brake lever. The support means brake device can thus be repositioned or shifted in simple manner.

The support means can be a support belt or also a cable. Instead of the band brake, use can obviously also made of a shoe brake or a disc brake. If required, the engineer who operates the support means brake device can also observe a dispensing speed of the support means roller. If, for example, the engineer has to rapidly brake the entering support means the engineer can let go the brake lever and can stop the support means roller by a suitable braking aid. Slackening of the support means between support means roller and support means brake device is thus counteracted. However, in general this is not required, since the support means roller usually has sufficient intrinsic friction.

DESCRIPTION OF THE DRAWINGS

Embodiments of the invention are described by way of example in the following on the basis of schematic figures. Equivalent parts are provided in the figures with the same reference numerals.

DETAILED DESCRIPTION

Figure 1:
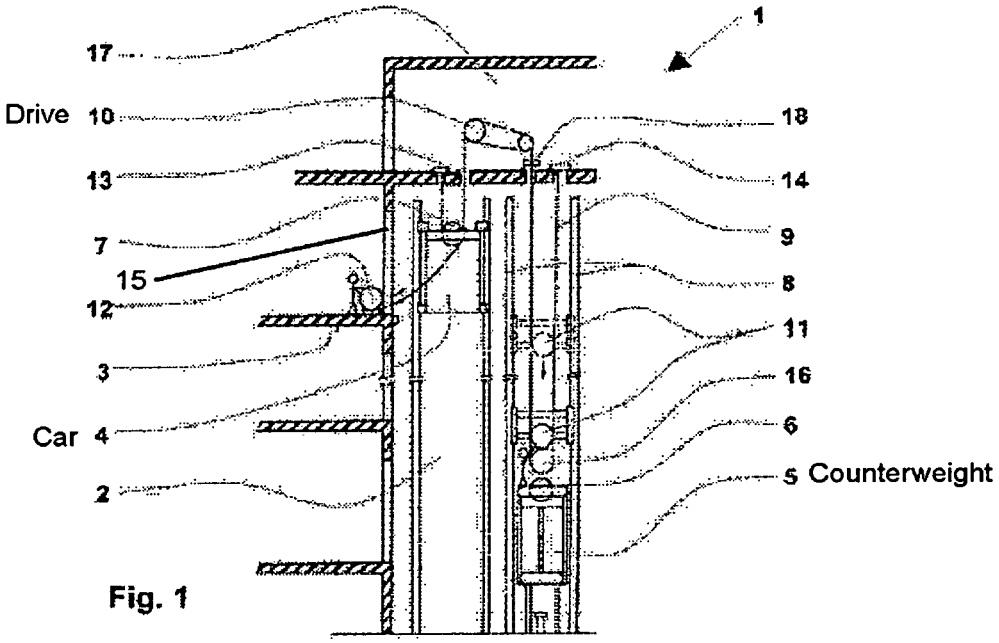
FIG. 1 discloses introduction of a support means into an elevator installation according to the prior art, FIG. 2 discloses introduction of a support means into a first elevator installation by way of use of a support means brake device, FIG. 3 discloses introduction of a support means into a second elevator installation by way of use of a support means brake device.

FIG. 1 shows an assembly method for introducing a support means 9 into an elevator installation 1, such as is known from the prior art. The elevator installation 1 is installed in a shaft 2. For installing the elevator installation 1, principal components of the elevator installation such as car 4, counterweight 5 and drive 10 are assembled and installed at appropriate locations in the building, in the shaft, in the machine room 17 or in other associated spaces. In the example, the elevator car 4 or at least substantial parts thereof is or are preassembled at an upper region of the shaft 2 and the counterweight 5 is preassembled in a lower region of the shaft 2. The illustrated elevator installation is a looped-suspension or 2:1 suspended elevator arrangement. In that case, the elevator car 4 and the counterweight 5 are suspended by way of at least one supporting or deflecting roller 6, 7. The support means 9 are also installed at an earliest possible point in time so as to then be able to move the elevator. In that regard, the support means 9, which is wound up on a support means roller 12, is provided in an uppermost floor 3 of the building. The support means 9 is unwound from the support means roller 12 and introduced into the shaft 2 of the elevator installation 1.

For that purpose, a first end of the support means 9 is guided through an uppermost floor door 15 and pulled to the drive 10. It is further led around a pulley of the elevator drive 10 and subsequently the first end of the support means is fastened to a support means fastening point 14. Insofar as the drive 10 is arranged in a machine room, the support means is obviously led through possible openings in the floor of the machine room. The support means 9 is then lowered in the form of a loop 16 into the elevator shaft 2, in which case the loop 16 of the support means 9 is preferably weighted and guided by means of a guide roller 11.

The support means 9 is thus substantially drawn into the shaft 2 by the intrinsic weight of the support means 9 and the mass of the guide roller 11. The guide roller 11 is guided on guide rails 8 and prevents twisting of the support means loop 16. After the loop 16 of the support means 9 has been brought substantially to its intended length in the shaft 2, the loop 16 of the support means is released from the guide roller 11 and laid around the appropriate deflecting roller 6 of the counterweight 5. A second end of the support means 9 is, after it is unrolled from the support means roller, laid around the corresponding deflecting roller 7 of the elevator car 2, temporarily secured by way of a support means clamp 18 and finally fastened to a support means fastening point 13 on the car side. The procedure is the same for each further support means 9 until all the support means 9 are installed. This procedure contains a risk that, particularly in a final phase of drawing in the support means, this slides off the support means roller and slips into the shaft.

Figure 2:
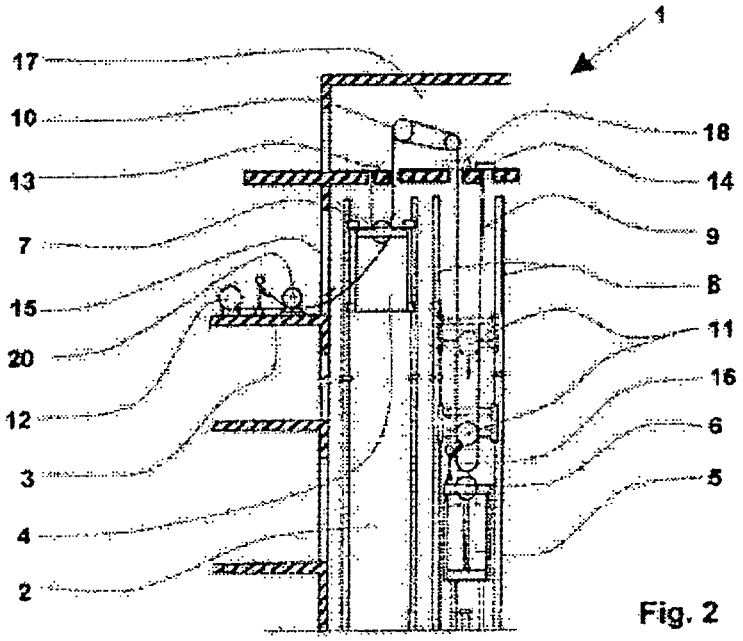

FIG. 2 shows an optimized method which improves the introduction, which is disclosed in the prior art, of the support means 9 into the elevator installation. In this first embodiment, by contrast to FIG. 1, a support means brake 20 independent of the support means roller 12 is arranged between the support means roller 12 and the shaft 2 of the elevator installation 1. Drawing-in of the support means or the intake speed thereof can be controlled or regulated by way of this support means brake 20. Otherwise, the procedure for introducing the support means is substantially the same as was explained in connection with FIG. 1. The support means brake 20 is operated by a member of the installing team. This person regulates—in the example, manually—a braking force by which the support means 9 is to be braked and thus regulates an intake speed of the support means. In practice, the intake speed is approximately in the region of 0.2 m/s (meters per second) to 0.4 m/s. Since a manual setting of this intake speed is involved, the effective speed plot is obviously fixed by a routine and expert knowledge of the installing personnel. When carrying out the setting, the member of the installing team takes into consideration possible reports from work colleagues who observe and help with the intake process at critical places in the elevator.

Figure 3:
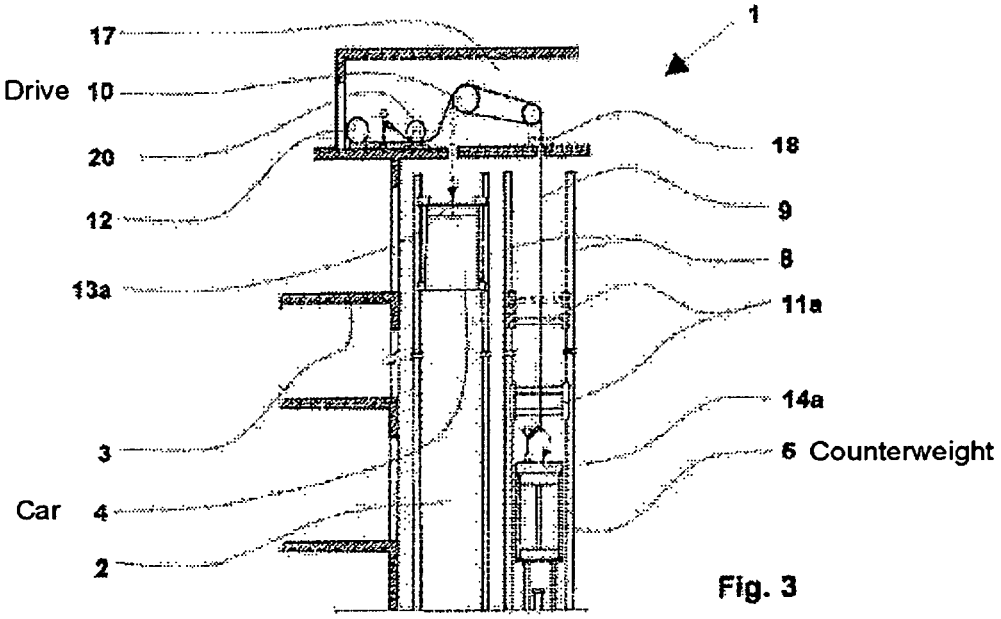

FIG. 3 shows use of the optimized method in an elevator installation with direct or so-called 1:1 suspension. The support means 9 is in that case not fastened by way of a deflecting or supporting roller at the car and the counterweight. In particular, it is fastened directly by the respective support means ends, obviously by way of appropriate fastening points 13*a*, 14*a*, to the car and the counterweight. By contrast to the method shown in FIG. 2, in this example the support means roller 12 is provided in the machine room 17 of the elevator installation 1 and the support means brake 20 is arranged after the support means roller 12. The support means 9 is, after guidance through the support means brake 20, placed over or around the pulley of the drive 10 and guided into the shaft 2. In the shaft 2, the first end of the support means is fastened to a guide carriage 11*a* and the support means 9 is subsequently lowered into the elevator shaft 2. The guide carriage 11*a* in that case prevents the support means 9 from twisting or untwisting. The drawing-in of the support means or the intake speed thereof can be controlled or regulated by way of the support means brake 20 as explained in connection with FIG. 2. The support means 9 is thus drawn into the shaft 2 substantially by the intrinsic weight of the support means 9 and the mass of the guide carriage 11*a*. After the support means 9 has been introduced into the shaft 2 substantially up to its intended length, the first end of the support means 9 is detached from the guide carriage 11*a* and fastened to the support means fastening point 14*a* on the counterweight side. The second end of the support means 9 is, after it is unrolled from the support means roller, as illustrated by dashed lines, temporarily secured by way of the support means clamp 18 and finally fastened to the elevator car 4 at the support means fastening point 13*a* on the car side. The procedure is the same for each further support means 9 until all support means 9 have been installed.

The examples according to the FIGS. 2 and 3 show the method for introducing the support means 9 into the elevator installation on the basis of an assembly situation in which the car has been preassembled in an upper region of the shaft or at least placed there after preassembly. The counterweight is correspondingly positioned in a lower region of the shaft and, in particular, so that the car and counterweight are positioned at approximately the same distances from the end of the respective travel path. The arrangement could obviously also be selected to be reversed, wherein then the support means 9, instead of being lowered to the counterweight, was correspondingly lowered to the car. The positioning of the support means roller 12 at the support means brake 20 in the two examples can obviously take place on a floor 3 or in the machine room 17. The selection depends on spatial conditions, access or the practice of the assembly personnel. Moreover, for example, the support means roller can also be arranged in an antechamber relative to the machine room or the floor. The spatial conditions are also taken into consideration there. In the examples, the support means 9 is led in doubled looping around the drive 10. The transmissible drive moment can thereby be increased. This double looping is also by way of example and is not absolutely necessary. Equally, use can obviously also be made of drives 10 which do not have so-called counter-rollers.

Possible embodiments of a support means brake 20 are now illustrated in FIGS. 4 to 9. The support means brake 20, as evident in the overall view of FIG. 4, consists of a traction pulley 21 which is rotatably mounted in a support frame 22. The traction pulley 21 is constructed so that it receives the support means in a traction groove 25 or so that the support means can loop around the traction pulley in the traction groove 25. The support means 9 is in that case guided from the support means roller 12 to the traction groove, loops around the traction pulley in the traction groove 25 and is guided by way of a support means departure guide 26 from the traction groove 25 in a departure direction 27 to the shaft 2 of the elevator. The support means brake device 20 further includes a pressing roller 28, which is arranged in the vicinity of the location at which the support means runs onto the traction pulley. A support means run 9*a* which runs in is pressed by this pressing roller 28 against the traction pulley or the traction groove of the traction pulley. Pressing is effected by means of a spring device 29, wherein a spring presses the pressing roller 28 against the support means by way of a lever system. On introduction of the support means into the elevator, the traction pulley is consequently rotated in correspondence with the intake speed of the support means.

Figure 5:
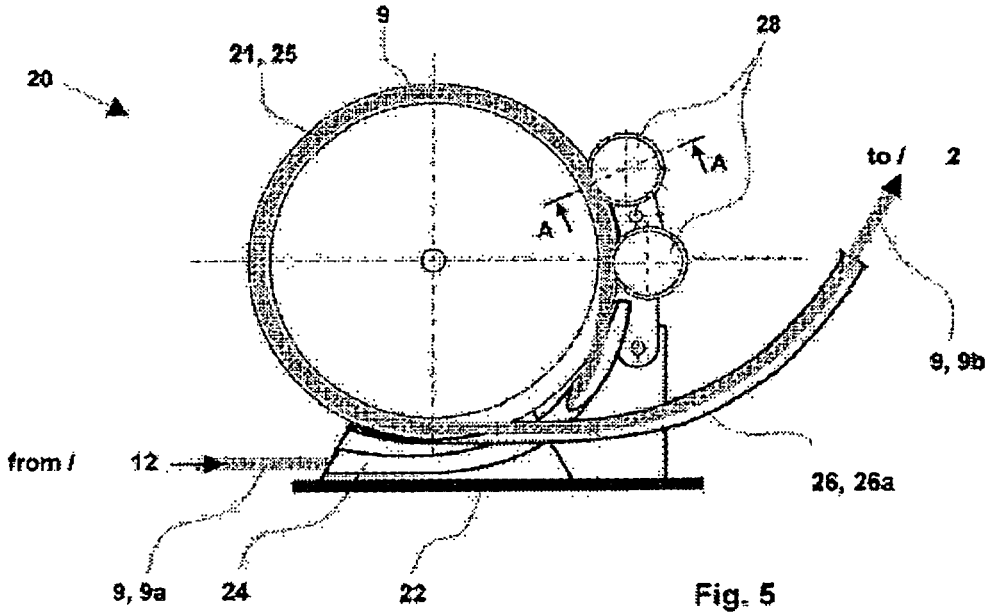
FIG. 5 shows a first sectional illustration of the support means brake device of FIG. 4.
Figure 10:
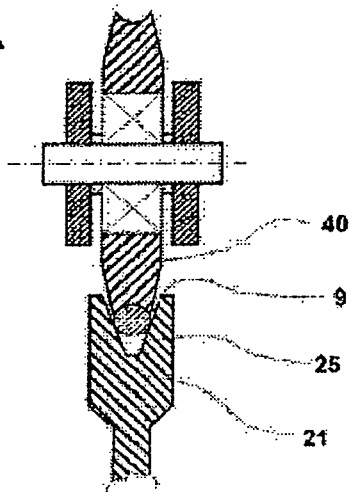
FIG. 10 shows a section A-A through a pressing roller of FIGS. 5, 6 or FIG. 9

The guidance of the support means around the traction pulley 21 is more clearly apparent in FIG. 5. The support means run 9*a*, which is running in, of the support means 9 is picked up by a support means entry guide 24 arranged in the support frame 22. The support means entry guide 24 picks up the support means—at the back in the view—offset with respect to a plane of the traction groove 25. It guides the support means in a curve to the plane of the traction groove 25 so that the support means runs into the traction groove 25 below the pressing roller 28. In the example, the pressing roller 28 is a rocker construction with two pressing rollers 28. In FIG. 10 a sectional illustration A-A of how the pressing roller 28 presses the support means 9 into the traction groove 25 of the traction pulley 21 is schematically depicted. Continuing on from the pressing roller 28, the support means 9 runs to approximately three-quarters around the traction pulley 21. The diameter of the traction pulley 21 in the example is approximately 400 mm (millimeters). Such a diameter enables handling of cables in the diametral range up to 19 mm. It is thereby ensured that the traction means is not excessively bent. In the lower region of the traction pulley 21, after looping around the same, the support means 9 is picked up by the support means departure guide 26 which guides the support means away to the shaft 2 or to the drive 10. The two support means guides are thus so constructed that the support means run which runs in and the support means run which runs away do not obstruct one another. The support means guides guide the two support means runs laterally past one another. In that case, in the present embodiment the support means run which is running away runs linearly away from the traction groove, whereas the support means run which is running in runs laterally past the departing support means run at an offset and is then guided in a curve to the traction groove. Thus, the entering run stressed by a small force is deflected. In the example according to FIG. 5 the support means departure guide 26 consists of an appropriately formed guide tube 26*a*, which guides the support means as explained in the foregoing. In the example according to FIG. 6, the support means departure guide 26 comprises a guide roller 26*b* which deflects the support means so as to conduct it to the shaft directly or indirectly, for example by way of further rollers.

Figure 4:
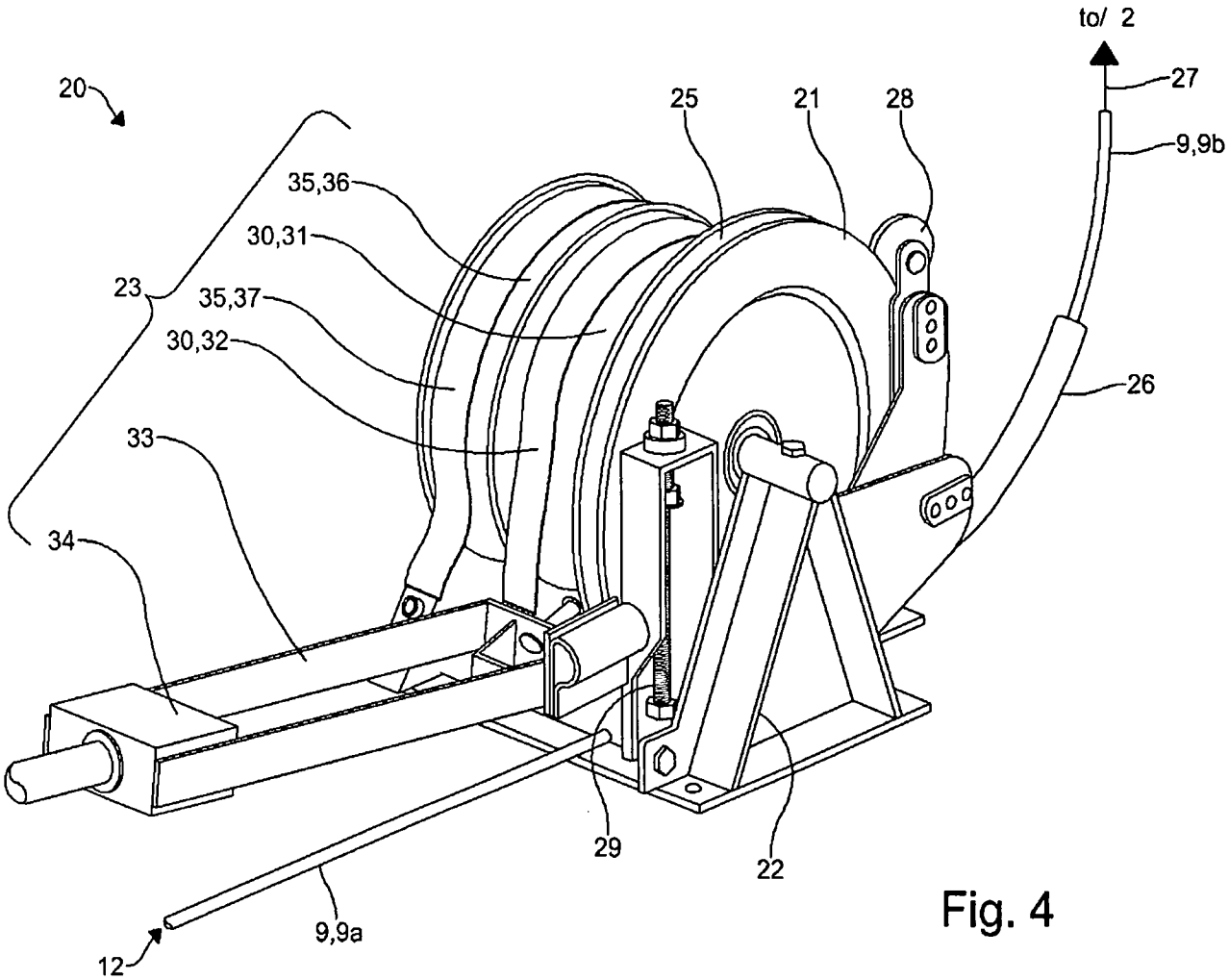
FIG. 4 shows an example of a support means brake device in an overall view.
Figure 7:
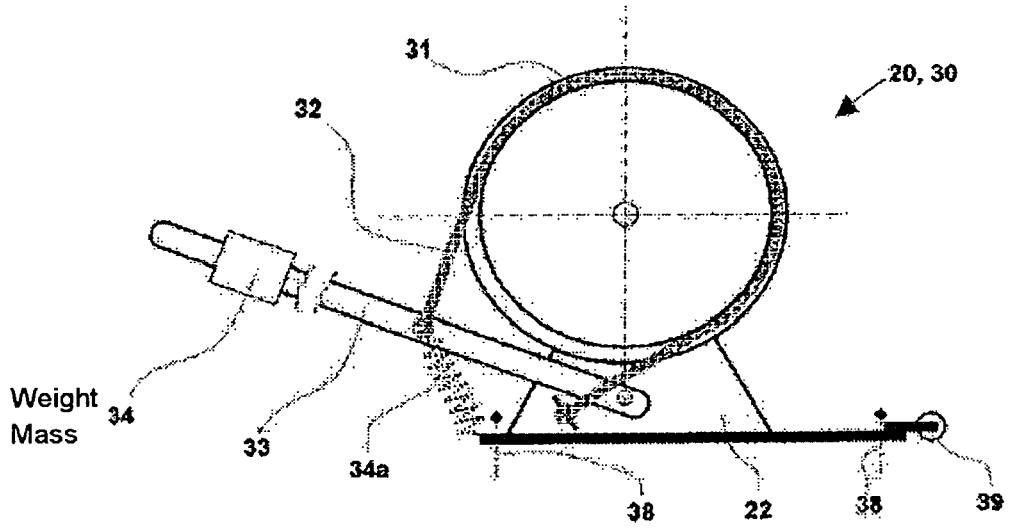
FIG. 7 shows a second sectional illustration of the support means brake device of FIG. 4.
Figure 8:
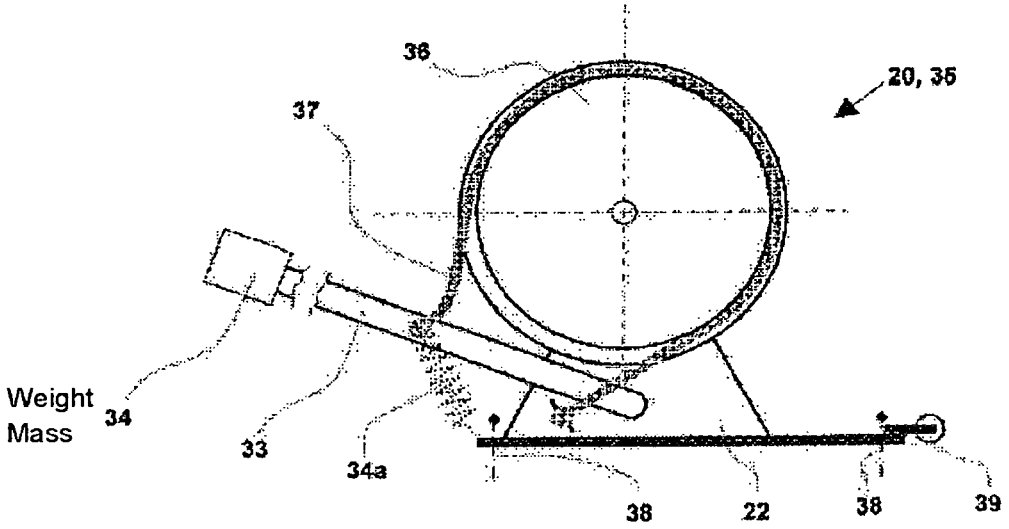
FIG. 8 shows a third sectional illustration of the support means brake device of FIG. 4.

The traction pulley 21 is, as again apparent in FIG. 4, connected with a pulley brake device 23. The traction pulley 21 can be braked when required by means of this brake device 23. There is thus the effect that the support means 9 is moved together with the traction pulley 21, i.e. that the support means normally does not slip on the traction pulley. The support means 9 is protected, since it does not have to slide on the traction pulley, but it is moved in company with the traction pulley 21. Due to the fact that the brake device 23 acts on the traction pulley 21, well-defined braked partners are present in the action thereof and the braking is correspondingly reliable. The brake device 23 in the present embodiment consists of a first band brake 30 and a second band brake 35. The first band brake 30 is constructed as a main brake and the second band brake 35 is constructed as an emergency brake. The second band brake 35 comes into function when the first band brake 30 fails, thus, for example, when a brake band 32 of the first band brake 30 fails. FIGS. 7 and 8 respectively illustrate the first band brake 30 and the second band brake 35.

The brake band 32 of the first band brake 30—see FIG. 7—is laid around a band disc 31 of the first band brake 30. A first end of the brake band 32 is fastened in the support frame 22. A second end of the brake band 32 is connected with a brake lever 33. The brake lever 33 is pivotably fastened in the support frame and a weight mass 34 stresses the brake lever so that the brake band 32 of the first band brake 30 bears against the band disc 31 and loops around this. The first band brake thereby produces a maximum braking force determined by the weight mass 34 and a resultant frictional force. This braking force is dimensioned so as to be able to hold or brake the support means during installing. According to experience, the maximum braking force is approximately 6,000 N (Newtons). The member of the installing team who operates the support means brake can now reduce the stress in the brake band 32 of the first band brake 30 by lifting the weight mass or the brake lever and thus reduce the braking force. The support means brake is 'fail safe'. This means that release of the brake lever sets the braking action to a maximum value.

The second band brake 35 is essentially inactive in the outlined operating case. A further brake band 37 of the second band brake 35—see FIG. 8—is laid around a further band disc 36 of the second band brake 35. A first end of the further band brake 37 is similarly fastened in the support frame 22. A second end of the further brake band 37 is connected with the brake lever 33. However, the further band 37 is slightly longer than the brake band 32 of the first band brake 30. The second band brake consequently does not brake in the operating case outlined in the foregoing, since the looping stress runs, to substantial parts, via the brake band 32 of the first band brake 30. The further band 37 is laid loosely around the further band disc 36.

If, however, the brake band 32 of the first band brake 30 should fail, for example tear, the further band 37 of the second band brake 35 is automatically stressed by the weight mass 34 and braking correspondingly takes place by way of the second band brake 35. The material of the brake band 32 of the first band brake 30 is preferably plastic, for example a cable or a band with polyurethane casing. The material of the further brake band 37 of the second band brake 35 is preferably steel, for example a steel cable or a steel band. If required, a cable can loop around the band disc a plurality of times.

Alternatively, instead of the weight mass 34 or additionally thereto use can be made of a spring 34*a* in order to be able to generate the required braking force. Obviously, unloading of the weight mass 34 with respect to the center of gravity of the brake lever can possibly be varied in order to achieve other maximum braking forces.

The support frame of the support means brake 20 is, in the present example, fastened to the surface of the floor 3 by means of usual dowels 38. As a feature, the support means brake 20 according to the present invention comprises a transport wheel 39 which is so fastened to the support frame that in the illustrated installation position it does not contact the floor. However, for the purpose of transport the support means brake 20 can be raised on one side with the help of the brake lever—the brake lever can, for example, be fixed in the support frame for that purpose—and the support means brake 20 can be simply displaced or shifted like a wheelbarrow.

Figure 9:
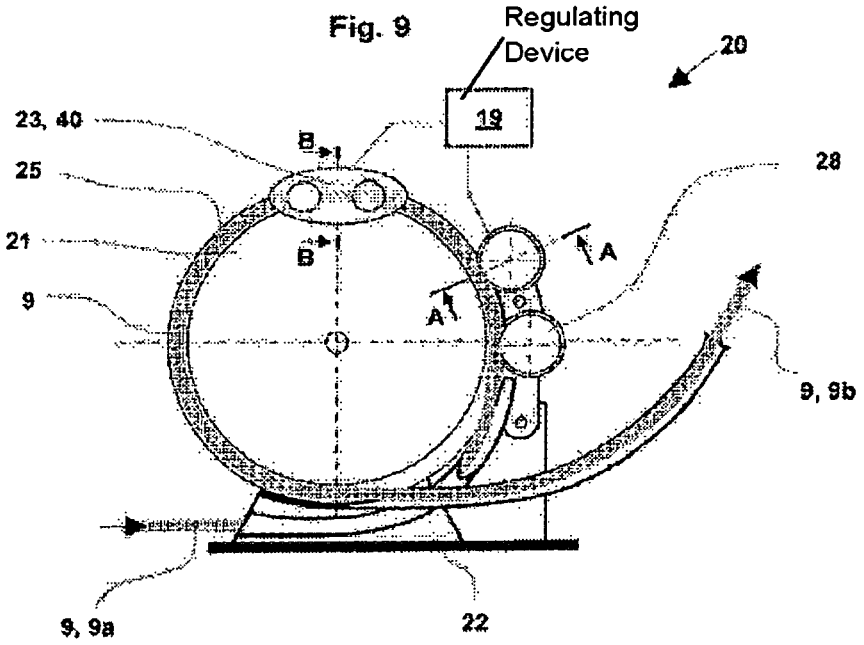
FIG. 9 shows an example of a further support means brake device.

FIG. 9 shows an alternative embodiment of the brake device 23. The design of the traction disc 21 and looping around by the support means 9 correspond with the explanations made with reference to FIGS. 5 and 6. However, in the present example, a disc brake 40 is used instead of band brakes. The disc brake 40 engages the traction disc 21 and can brake this directly.

Figure 11:
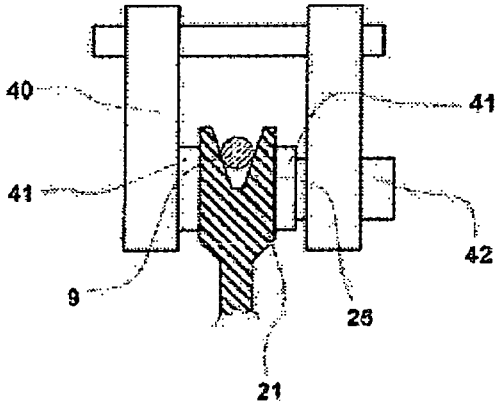
FIG. 11 shows a section B-B through a disc brake of FIG. 9.

When required, the disc brake 40 presses, as apparent in FIG. 11, brake linings 41 against flanks of the traction pulley 21 by means of an actuator 42, which is preferably electromechanical, and thereby brakes the traction pulley 21 and thus the support means 9 looped around the traction pulley. The brake device 23 can, in another embodiment, be a mechanically actuable saddle brake. The saddle brake can be urged by a spring into a brake setting and the saddle brake can then be released by means of a cable pull or lever so as to enable drawing-in of the support means. In one embodiment, the disc brake 40 can be regulated by a regulating device 19.

The expert will recognize further embodiments. Thus, for example, the expert can regulate the electromechanical actuator 42 of the disc brake 40 by the regulating device 19 or the expert can obviously also control or regulate the band brakes of the preceding examples by the regulating device 19. In that regard, an actual intake speed can be detected by the pressing roller 28 by means of a rotational speed transmitter and the regulating device can set a braking force of the disc brake so as to keep to a predetermined speed value.

Figure 6:
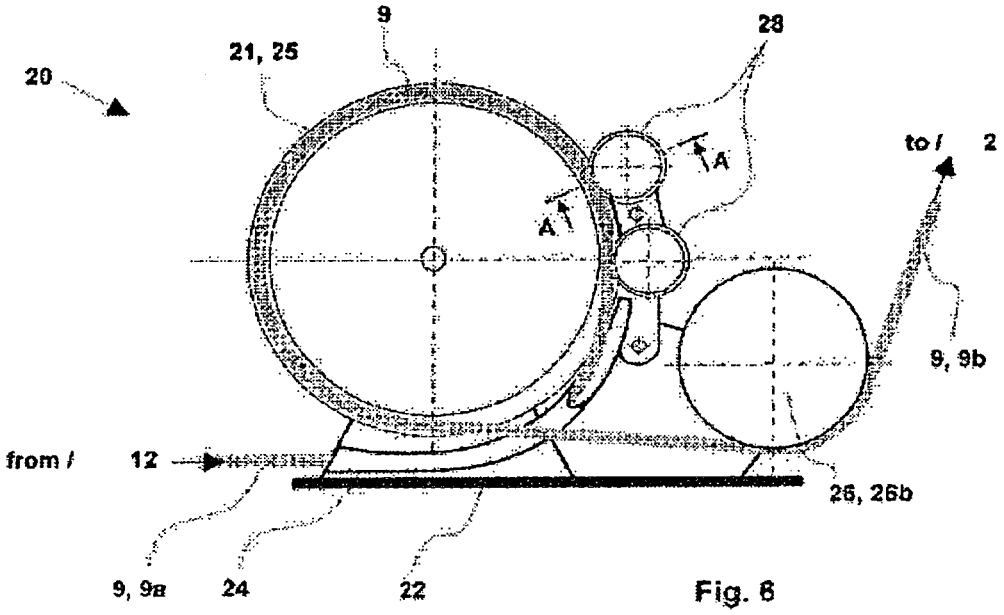
FIG. 6 shows an alternative embodiment with respect to the support means brake device of FIG. 4.

In addition, the support means brake 20 can be supported relative to walls or ceilings of the floor by supports instead of dowels and the form of the traction groove 25 is obviously adapted to the form of the support means. Several traction grooves 25 can possibly also be arranged adjacent to one another on the traction pulley. Several support means can thus be introduced into the shaft together. In addition, the embodiment, which is shown in FIG. 6, of the support means departure guide 26 by way of a guide roller 26*b* can obviously be combined with all other embodiments.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A method of introducing a support means of an elevator car into an elevator installation having a shaft, which shaft extends over a plurality of floors of a building, wherein the support means is wound up on a support roller positioned adjacent to the shaft so that the support means can be unwound from the support roller and introduced into the shaft, comprising the steps of:

arranging a support brake device between the support roller and the shaft of the elevator installation;

introducing the support means of the elevator car into the support brake device and then into the shaft of the elevator installation;

regulating a braking force of the support brake device applied to the support means of the elevator car by actuating a brake lever biased by a spring or a weight mass, and thereby controlling an intake speed of the support means of the elevator car into the shaft of the elevator installation using the support brake device; wherein in an absence of actuation of the brake lever a predetermined value of the braking force is set; pressing the support means against a traction pulley of the support brake device with a pressing roller; and wherein the support means loops around the traction pulley.

2. The method according to claim 1 wherein the support roller is positioned at an uppermost floor of the building or in a machine room of the elevator installation, comprising the further steps of:

introducing the support means into the support brake device by unrolling a first end of the support means from the support roller and guiding the first end through the support brake device;

further guiding the first end of the support means around or over a pulley of a drive of the elevator installation;

fastening the first end of the support means at a support fastening point; and lowering the support means in the shaft, wherein a loop of the support means is weighted and guided by a guide roller.

3. The method according to claim 1 wherein the support roller is positioned at an uppermost floor of the building or in a machine room of the elevator installation, comprising the further steps of:

introducing the support means into the support brake device by unrolling a first end of the support means from the support roller and guiding the first end through the support brake device;

further guiding the first end of the support means around or over a pulley of a drive of the elevator installation; and lowering the support means in the shaft, wherein the support means is weighted and guided by a guide slide.

4. The method according to claim 1 wherein the regulating of the braking force of the support brake device is effected by manual actuation of the brake lever.

5. A support brake device for controlling an intake speed of a support means on introduction of the support means into an elevator shaft in a building comprising:

a traction pulley for receiving a section of the support means, wherein the traction pulley is rotatably mounted in a support frame and the traction pulley is configured so that the support means loops around the traction pulley;

a brake device for applying a braking force to the traction pulley and for controlling the intake speed of the support means, wherein the brake device includes a brake lever biased by a spring or a weighting mass wherein a predetermined value of the braking force is settable and applied to the support means in an absence of actuation of the brake lever; and a pressing roller arranged to press the support means against the traction pulley in a location at which the support means runs onto the traction pulley, wherein the pressing roller is pressed against the traction pulley by a spring device.

6. The support brake device according to claim 5 further comprising:

a support entry guide for receiving a first support run of the support means running into the support brake device, wherein the support entry guide is configured to guide the support means from a substantially horizontal entry direction to a traction groove of the traction pulley; and a support departure guide for guidance away of a second support run of the support means from the traction pulley, wherein the support departure guide is configured to guide the support means from the traction groove of the traction pulley in a departure direction, wherein the support entry guide and the support departure guide are configured to prevent the first support run and the second support run from obstructing one another.

7. The support brake device according to claim 5 including a first band brake having a first band disc connected with the traction pulley and a first brake band, wherein the first brake band loops around the first band disc and the first brake band is tightened by the brake lever that is biased and manually actuable.

8. The support brake device according to claim 7 including a second band brake having a second band disc connected with the traction pulley and a second brake band that embraces the second band disc, wherein the second band brake can be brought into action by the brake lever if the first brake band fails.

9. The support brake device according to claim 8 wherein the traction pulley and the first and second band discs are rotatably mounted on the support frame and the support frame further mounts the brake lever, the support entry guide, the support departure guide, and the pressing roller, wherein the support frame is configured to be mountable on a floor of the building.

10. A method of introducing a support means of an elevator car into an elevator installation having a shaft, which shaft extends over a plurality of floors of a building, wherein the support means is wound up on a support roller positioned adjacent to the shaft so that the support means can be unwound from the support roller and introduced into the shaft, comprising the steps of:

arranging a support brake device between the support roller and the shaft of the elevator installation, the support brake device including a traction pulley for receiving a section of the support means, wherein the traction pulley is rotatably mounted in a support frame and the traction pulley is configured so that the support means loops around the traction pulley, and the support brake device further including a brake device for applying a braking force to the traction pulley and for controlling an intake speed of the support means, wherein the brake device includes a brake lever biased by a spring or a weighting mass wherein a predetermined value of the braking force is settable and applied to the support means in an absence of actuation of the brake lever;

introducing the support means of the elevator car into the support brake device and then into the shaft of the elevator installation;

regulating the braking force of the support brake device applied to the support means of the elevator car by actuating the brake lever, thereby controlling the intake speed of the support means of the elevator car into the shaft of the elevator installation using the support brake device; and pressing the support means against the traction pulley of the support brake device with a pressing roller.

* * * * *